United States Patent [19]

Schwartz et al.

[11] Patent Number: 4,457,696

[45] Date of Patent: Jul. 3, 1984

[54] LARGE CAPACITY AIR-POWERED SMOKELESS FLARE

[75] Inventors: Robert E. Schwartz; Roger K. Noble; Michael R. Keller, all of Tulsa, Okla

[73] Assignee: John Zink Company, Tulsa, Okla.

[21] Appl. No.: 300,175

[22] Filed: Sep. 8, 1981

Related U.S. Application Data

[63] Continuation of Ser. No. 78,646, Sep. 24, 1980, abandoned.

[51] Int. Cl.[3] ..... F23D 13/20

[52] U.S. Cl. ..... 431/202; 431/350; 431/354; 239/425

[58] Field of Search ..... 431/202, 284, 350, 354; 239/405, 424, 505, DIG. 7

[56] References Cited

U.S. PATENT DOCUMENTS

| | | | |
|---|---|---|---|
| 3,134,424 | 5/1964 | Zink et al. | 431/202 |
| 3,554,681 | 1/1971 | Proctor | 431/202 |
| 3,735,778 | 5/1973 | Garnier | 239/420 |
| 4,036,580 | 7/1977 | Reed et al. | 431/202 |
| 4,099,908 | 7/1978 | Beckmann et al. | 431/284 |

FOREIGN PATENT DOCUMENTS

| | | | |
|---|---|---|---|
| 923037 | 3/1973 | Canada | 431/354 |

*Primary Examiner*—Lee E. Barrett

*Attorney, Agent, or Firm*—Head, Johnson & Stevenson

[57] ABSTRACT

A large capacity air-powered flare for smokeless combustion of very large volumes of vented waste gases, comprises a first inner vertical conduit of diameter D1, for the flow of waste gas, and a second larger coaxial conduit of diameter D2, for the flow of primary combustion air, at a selected velocity in the annular space therebetween. Above the top the inner conduit there is a cylindrical obstruction of diameter D3 which is greater than D1, but less than D2. This forces the upwardly flowing gases to be deflected outwardly and upwardly into the second annular space between the obstruction and the outer conduit. The velocity of primary combustion air in the second annular space is at least 50 f.p.s., which serves to thoroughly mix with the inflowing gases so that as they rise through the second annular space they continue flowing above the top of the flare as an annular wall of high velocity gas, air and flame. This high velocity annular flow has large surface area on the outside and inside. Because of the high velocity of flow, secondary air is induced into the outside wall of this column, and also axially downwardly into the interior of this flow, where it moves radially outwardly to intersect the flowing gas and provide additional combustion air.

7 Claims, 7 Drawing Figures

LARGE CAPACITY AIR-POWERED SMOKELESS FLARE

This is a continuation application of Ser. No. 78,646, filed Sept. 24, 1980 now abandoned.

BACKGROUND OF THE INVENTION

1. Field of the Invention

This invention lies in the field of the smokeless burning of waste gases by means of flares.

Still more particularly, this invention relates to the construction of flares for the burning of very large flows of waste gas, of size 200,000 pounds per hour or greater.

Still more particularly, it concerns an improved type of construction for flares to burn large quantities of gas smokelessly with reduced expenditure of energy for pressurization of the primary combustion air.

2. Description of the Prior Art

In the prior art large high-powered flares for the smokeless burning of waste gas have been built, up to the size of about 100,000 pounds per hour, using the power of pressurized air for smokeless combustion. Such prior art devices were constructed in such a form that the primary combustion air was pre-pressured and pre-mixed with the waste gas in such a way that the total flow was in the form of a solid vertical cylinder of rapid upflowing gas and air, such that there was a large induction of secondary air around the outer periphery of this column of flame and gas.

Because of the surface area limitation to the flow of induced secondary air into the outer wall of the rising column of gas, and the necessity for the secondary air to penetrate to the center of the column in order to avoid incomplete and smoky combustion, there was a practical limit of the order of 100,000 pounds per hour for such flares. Such applications that had larger flows than this would require a duplication of two or more such flares to handle a total flow capacity.

By the present invention it is now possible to provide combustion of 200,000 pounds per hour in a single flare, or less with reduced expenditure of electrical energy for pressurizing the primary combustion air.

However, there is another serious problem in the smokeless combustion of hydrocarbons where the hydrogen to carbon ratio (H/C-R) is low. Ventings from an ethylene facility (principally olefinic, or unsaturated compounds) provides gases for smokeless flare burning where the H/C weight ratio can be as low as 0.166, and difficulty with smoky burning increases as the H/C ratio decreases. For example, consider methane (H/C=0.333) makes no smoke as it burns at the flare; ethane (H/C=0.25) makes faint trailing smoke, and propane (H/C=0.222) smokes relatively heavily. Smoke density increases as the H/C falls below 0.222, and difficulty in smoke suppression will vary as the potential smoke density increases. Thus, as the H/C-R decreases, means must be provided to increase the rate of induction of secondary air to provide smokeless combustion. With this invention it is possible to flare burn without smoke, large flows of waste gases, which are combustible, and which have H/C-R in the range of 0.333 down to 0.083 (acetylene).

SUMMARY OF THE INVENTION

It is the primary object of this invention to provide a smokeless combustion of flare-vented gases for the burning of large flows of waste gases with a minimum expenditure of electrical power for pressurizing the primary combustion air.

It is a further object of this invention to provide a flare for the smokeless combustion of waste gases where total flows of combustible gases can be handled which are considerably greater than the maximum flow possible with prior art equipment, and with reduced expenditure of energy for air pressurization.

It is a still further object to provide a flare for the burning of hydrocarbons having hydrogen to carbon ratios less than about 0.2, without smoking.

These and other objects are realized and the limitations of the prior art are overcome in this invention by providing a central inner vertical conduit of selected diameter D1, for the upward flow of waste gases to be flared. A second outer coaxial conduit of diameter D2, where D2 is greater than D1, is provided, which extends upwardly coaxial with the first conduit. The second conduit narrows to a smaller diameter D2A below the end of the first conduit. Pressurized air to a selected flow velocity is provided in the first annulus, between the inner and the outer conduits.

A closed cylindrical obstacle is provided, and supported in axial alignment with, and spaced slightly above the inner conduit. The outer diameter D3A of this obstacle is larger than D1 and smaller than D2A, so that the air flow up the first annulus is crowded into a narrower second annulus between the obstacle and the second conduit. The velocity of primary air flowing up the first annulus is suddenly accelerated and reaches a velocity in the range of 50 to 200 feet per second in the second annulus.

An annular cylinder of refractory material may be placed on the outer surface of the inner conduit extending downward from the top a selected distance. The outer diameter D3 of this refractory material is substantially equal to D3A. A conical passage of selected axial dimension, is maintained between the top of the refractory material and the obstacle so that the waste gases flowing up the inner conduit are deflected outwardly and upwardly through this annular passage, to intersect the upward flow of primary air in the second annulus substantially at the point of the vena contracta of the primary air. Because of the high velocity of the primary air in the second annulus at this point, there is turbulent and thorough mixing between the waste gases and the primary combustion air.

The primary combustion air comprises not less than eight to ten percent of the total air requirement for burning of the waste gases, but always less than total air requirement so that secondary air must be supplied. This is induced by the high velocity flow of this mixture of air and gases, sufficient to provide more than the stoichiometric quantity of air required.

The diameter of the central obstacle is of substantial dimension and forces the mixture of air and gases into a rapidly rising column, in the form of an annular wall, with a large circumferential area on both the outer surface and the inner surface.

Means are provided to ignite the gas at the top of the outer conduit, and the flame and air moving at high velocity induce secondary air flow inwardly from the outside of the column of rising gas and air. Also, there is induction of atmospheric air downwardly from above, along the axis of the flare, and outwardly against the inner surface of the rising annular column of gas.

Because of the large surface area of both the outer and the inner surface of the rising column, in contact with atmospheric air, and because of the relatively short radial distance that atmospheric air must move either inwardly or outwardly in order to mix with all of the gas in the wall, the efficiency of induction of secondary air is very high. Therefore, a very large quantity of waste can be handled, with no more expenditure of power for primary air, than would otherwise be required for a much lesser flow under the prior art system.

A further improvement is provided in the form of a plurality of radial baffles, tangentially spaced, across the annular space between the central obstacle and the outer conduit. These baffles cause the rising flow of gas and air to divide and flow around the baffles. Also, because of the reduction of cross-section, the velocity of flow is increased, and increased induction of secondary air is provided.

Also, because of the high gas velocity on both sides of the baffles, the pressure on top of the baffles will be reduced below atmospheric pressure. Thus, air will be drawn in along the top of the baffles from outside of the outer conduit, into the space inside of the rising annular wall of gas and air, and into the rising gas-air flow to further supplement the air supply for rapid and smokeless burning inside the rising annular wall of gas-air mixture.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
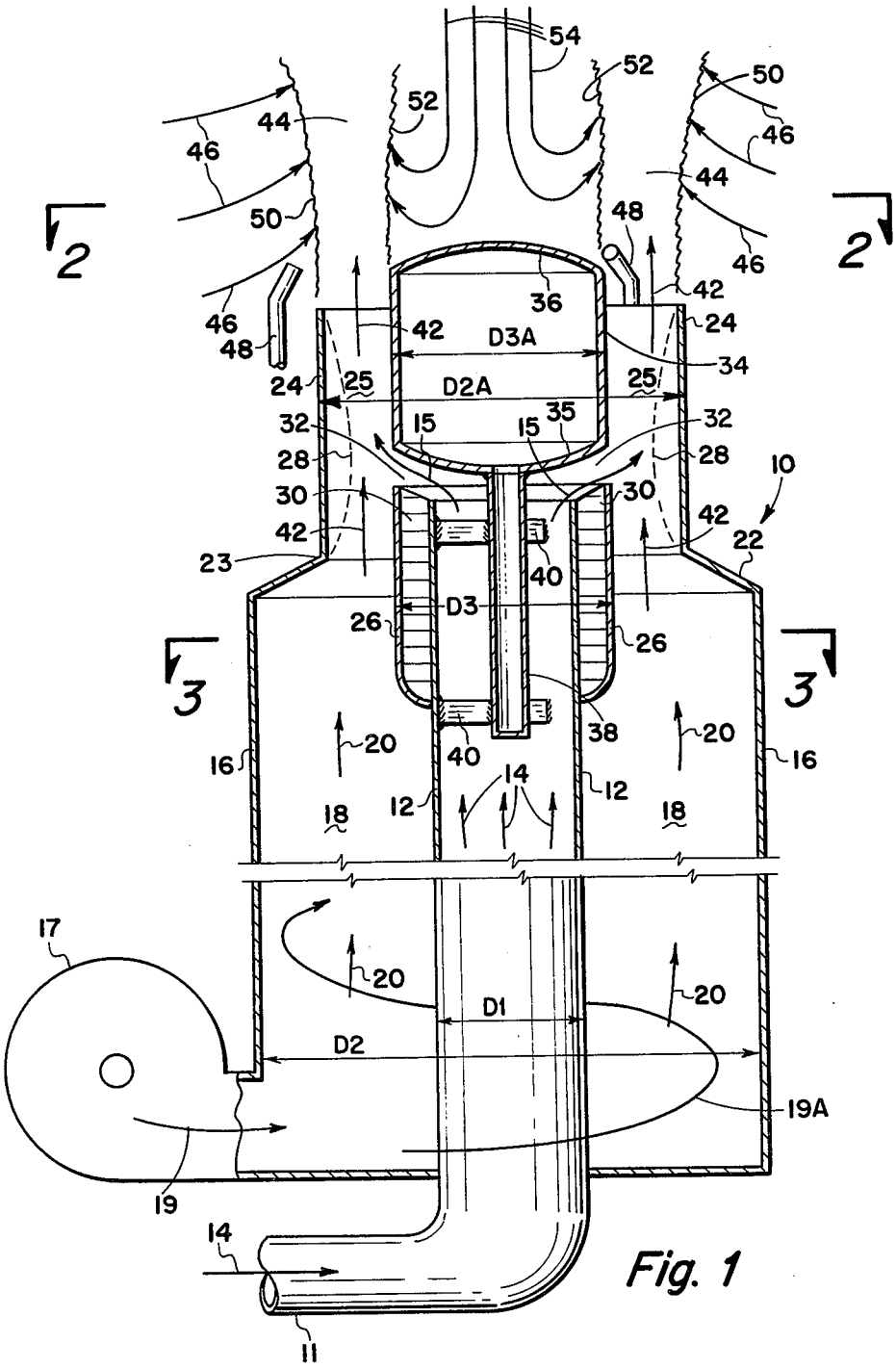
FIG. 1 is a vertical section of one embodiment of this invention.

Referring now to the drawings and, in particular, to FIG. 1, there is shown one embodiment of this invention illustrated in cross-section, indicated generally by the numeral 10.

The waste gases flow from their source, through the conduit 11 and up to the conduit 12 in accordance with arrows 14. Conduit 12 is of diameter D1.

There is a second larger, outer conduit 16 of diameter D2, which is closed at the bottom around the inner conduit 12, into which primary combustion air is flowed under selected pressure by means of blower 17, in accordance with arrow 19. The air flow from the blower flows into the bottom of the annular space 18, between the inner and outer conduits. The annular space 18 between the inner 12, and outer 16, conduits is designated as the first annular space.

The air flow 19 from the blower 17 may enter the space 18, axially or radially, in which case it will flow vertically in the first annular space in accordance with arrows 20. Alternatively, the blower can be mounted tangentially to the conduit 16, in which case the air will flow upwardly in the form of a helix in accordance with arrow 19A. The helical flow adds turbulence, which assists in the mixing of air and gas.

The second conduit 16 may be reduced in diameter above the point 23 to the diameter of 24, for the purpose of increasing the velocity of the upward flow of air in the space 25. The diameter of this reduced conduit 24 is designated D2A.

Above the top of the inner conduit 12 there is a closed cylindrical object or obstacle 34, which has a curved bottom surface and a curved top surface. It is supported by pipe 38, which is supported by spacers 40, inside of, and coaxial with the inner conduit 12. There is a vertical gap between the top of the conduit 12 and the obstacle 34 for the outflow of gases in accordance with arrows 15. The obstacle is of outer diameter D3A. It is preferred that the top 36 of the obstacle 34 be above the top of the conduit 24.

A shroud 26 of outer diameter D3 is substantially, not necessarily dimensional, equal to D3A of the obstacle 34 is fastened to the outer surface of the conduit 12, and the space between the conduit 12 and the shroud 26 is filled with a refractory material 30. This may be a castable material, not necessarily refractory, since the temperature at this point does not warrant refractory material. The top surface of the refractory material defines a conical passage 32 leading from the inside of the conduit 12, out into the second annular space 25 at a point substantially at the vena contracta of the air flow between the obstacle 34 and the top portion of the outer conduit 16. The approximate vena contracta is shown by dotted line. This second annular space is of selected inner and outer diameter, such that under the rapid flow of the primary combustion air 20, mixing with the outwardly flowing gases 15, there will be a rising annular column 44 of gas and air substantially vertically from the second annular space in accordance with arrows 42. Means such as 48 are provided for igniting the gas. Therefore, there will be flame and hot air and gas rising above the top of the flare.

The purpose of the shroud 26 is to decrease the radial width of the second annular space 25 to increase the flow velocity of primary air 42 prior to mixing with the gas flow 15.

The preferred value of the ratio D2/D1 is approximately 1–7. It can be larger or smaller depending on the desired flow velocity of the gas-air mixture in the second annular passage. The preferred value of flow velocity is 75 ft./sec., but can be as high as 200 ft./sec. or more, or as low as 50 ft./sec., depending on the composition of the waste gas and its hydrogen to carbon ratio.

Because of the high velocity of the rising air/gas mixture 44, secondary combustion air will be induced radially inwardly and outwardly, in accordance with arrows 46 into the outer surface 50 of this annular column 44. Also, there will be a reduced pressure directly above the obstacle 34, which will cause a downflow of atmospheric air 54, which will then be deflected outwardly into the inner surface 52 of this annular wall of gas. Because of the relatively large diameter of the obstacle 34 and the outer conduit 24 there will be a very large surface area for contact and mixing between the induced secondary air 46 and the rising column 44. Also, there will be a large contact area of the inner surface 52, which will likewise be receiving and mixing with the induced secondary air 54.

Because of the relatively narrow radial dimension of the annular column the penetration depth required of the atmospheric air in order to contact the entire volume of gas in the annular wall will be very much less than that required when the rising column of gas is in the form of a solid cylinder. Consequently, the efficiency of induction and contact of secondary air with the rising column of gas and primary air, will make this embodiment very efficient in the smokeless combustion of very large flows of waste gases, without substantial increase in the amount of electrical energy required to provide the pressurized primary air.

Because of this greater efficiency of mixing of the primary air with the waste gases and the more efficient induction and mixing of secondary air, the embodiment shown in FIG. 1 is more efficient than the prior art devices and, therefore, can handle much larger flows of gas with the same amount of energy required for pressurizing the primary air. Experience shows that primary air flow in the quantity of about eight to ten percent of the total stoichiometric flow is adequate to provide smokeless combustion of very large flows of gas.

Figure 2:
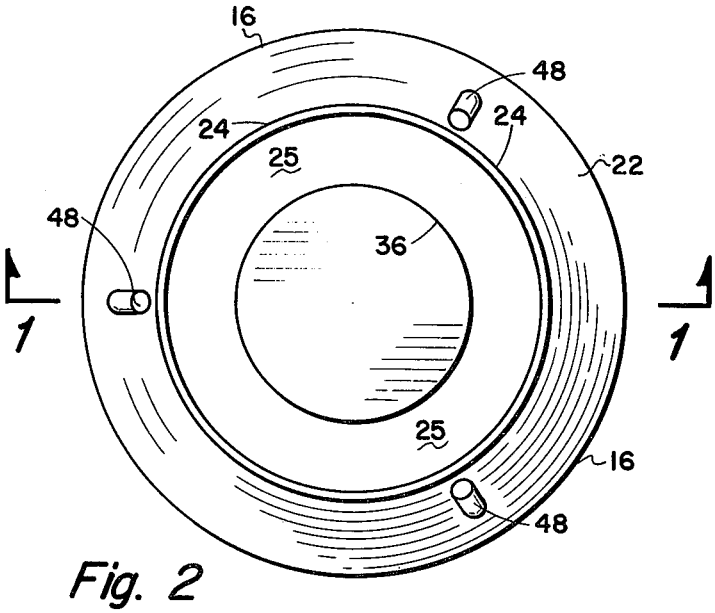
FIGS. 2 and 3 are cross-sectional views taken respectively across the planes 2—2 and 3—3 of FIG. 1.
Figure 3:
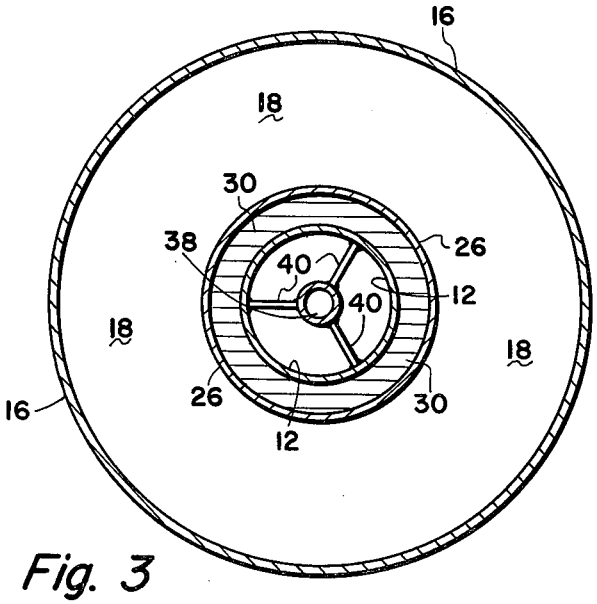

Referring now to FIGS. 2 and 3, there are shown two views in cross-section taken across the planes 2—2 and 3—3, respectively, of FIG. 1. The drawings are self-explanatory and identical numerals are used to identify identical parts.

An improvement in the first embodiment shown in FIG. 1 is illustrated in FIGS. 4–7. The improvement lies in the use of a plurality of circumferentially spaced radial baffles 60 across the second annular passage 25. While four such baffles are shown, there can be any desired number. The baffles are flat bars which extend from the outer conduit 24 transverse to the air-gas flow, up to the wall of the obstacle 34. They can be attached, as by welding 68 to outer conduit 24, or to both 24 and 34. Air-gas flow in passage 25, which is not covered by baffles, is unimpeded, but the gas-air flow velocity is increased by the reduction of cross-section.

Figure 7:
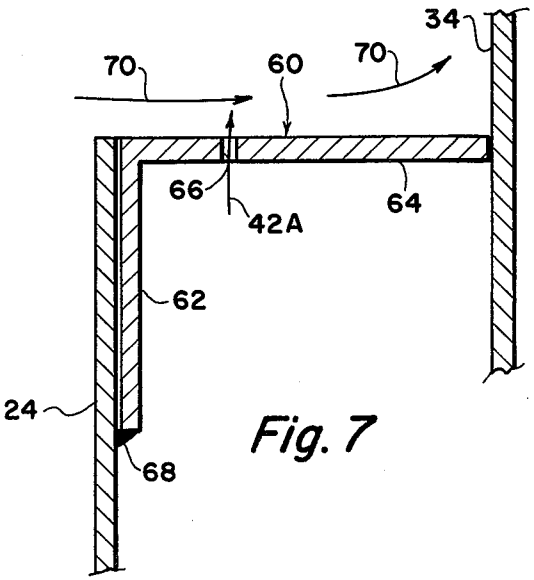
Figure 4:
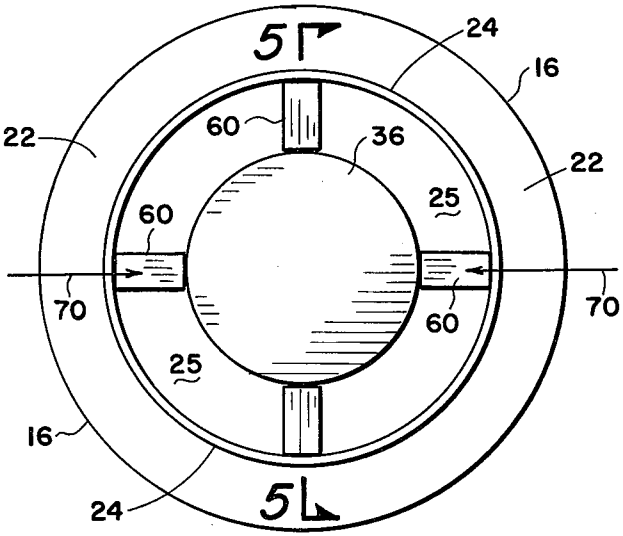
FIGS. 4 and 5 show plan and cross-sectional views of a modification of FIG. 1.
Figure 5:
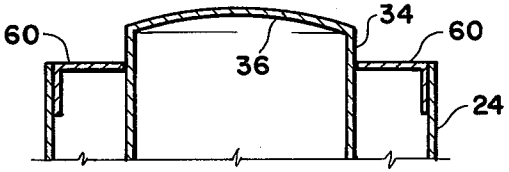

The purpose of the baffles is to cause accelerated indraft or induction of secondary air 70, FIGS. 4 and 7, to the area above the obstacle for enhancing burning. The air 70 moving inwardly over the baffles adds to the flow of secondary air 54.

This induction effect exists because when a baffle such as those shown in FIGS. 3–7 is transverse to (or blocks) flow, as in passage 25, where the flow 42 is at significant velocity, the pressure above the baffle is reduced according to $V^2/2$ g flow energy of 42. If the pressure of air immediately adjacent to the top of 24 is atmospheric, the low-pressure at the upper surface of the baffle causes air flow 70, and since the pressure above obstacle 36 is equally low, the air thus induced flows to the area above 36 to add to 54.

Figure 6:
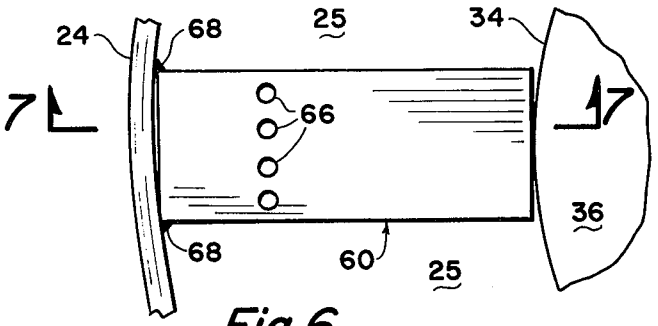
FIGS. 6 and 7 show details of the modification of FIGS. 4 and 5.

The baffles may be either solid, or may be perforated with closely adjacent ports 66, which are substantially aligned as in FIG. 6 for continuous ignition across the baffle because of air travel to their vicinity. The baffles may be perpendicular to the wall of the outer conduit or at a selected angle upwardly or downwardly to the horizontal.

The length of the reduced diameter D2A portion 24 above point 23 is very short as compared to the length of conduit 16 in order to minimize the distance traveled by the high velocity air flow 42 and thus minimize linear pressure drop within the annular space 25. This reduces the energy demand that would otherwise be necessary to overcome excessive pressure drop. In a typical field service situation the length of portion 24 is about three feet while the length of conduit 16 can be upwards of 200 feet. The flow velocity of air in space 18 is but a fraction of the velocity as the air passes the orifice 23 (75 feet per second preferred) into space 25, the ratio being a function of D2A to D2.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification but is to be limited only by the scope of the attached claims, including the full range of equivalency to which each element or step thereof is entitled.

What is claimed is:

1. A flare for smokeless combustion of vented waste gases, comprising;

(a) an inner vertical first conduit of diameter D1, for the upward flow of waste gases for burning, said first conduit having an open top;

(b) an outer vertical second conduit of diameter D2 larger than D1, substantially coaxial with said first conduit, and extending to a top which is above the top of the first conduit, said second conduit forming a substantially enclosed chamber thereabout having a first annular passage between the two conduits, the bottom of the second conduit connected with an air mover means through which primary combustion air is forced at greater than atmospheric pressure by said air mover means;

(c) closed cylindrical obstacle means of diameter D3A greater than D1, but less than D2, supported axially above the top of said first conduit by a selected distance, and extending upward to at least the top of said second conduit, forming a second annular passage above said first annular passage between said obstacle means and said second conduit;

whereby said waste gas flowing from the top of said first conduit is deflected outwardly to intersect and mix with the rising column of primary combustion air flowing in said second annular passage; and (d) means to ignite and burn said mixture of gas and air at the top of said second annular passage.

2. The apparatus as in claim 1, in which said closed cylindrical obstacle is formed of refractory material.

3. The apparatus as in claim 1, including a reduction of diameter of said outer vertical conduit, near its top, equal to D2A, which is greater than D3, to provide a selected radial width across said second annular passage.

4. The apparatus as in claim 1 in which the velocity of flow of said primary combustion air is in the range of 50 to 200 feet per second, or more, in said second annular passage.

5. The apparatus as in claim 1, including means to cause said primary combustion air to flow helically upward.

6. Apparatus of claim 1, wherein the location of the outlet of the inner conduit below the top of the outer conduit is located at a point of vena contracta-induced maximum velocity flow of said primary air in the second annular passage.

7. Apparatus of claim 1, including a plurality of equally spaced baffles extending across the flow of air-gas mixture in the second annular passage adjacent the top of the outer conduit said baffles include at least one opening whose axis is parallel to the axis of the outer conduit.

* * * * *